United States Patent [19]

Prouty

[11] Patent Number: 5,064,149

[45] Date of Patent: Nov. 12, 1991

[54] KITE WITH CONNECTORS FORMED OF SHEET MATERIAL

[76] Inventor: Jonathan J. Prouty, P.O. Box 3065, Boulder, Colo. 80307

[21] Appl. No.: 463,021

[22] Filed: Jan. 10, 1990

Related U.S. Application Data

[63] Continuation-in-part of Ser. No. 319,681, Mar. 7, 1989.

[51] Int. Cl.[5] ..... B64C 31/06

[52] U.S. Cl. ..... 244/155 A; 244/155 R; 244/153 R

[58] Field of Search ..... 244/155 A, 153 R, 155 R

[56] References Cited

U.S. PATENT DOCUMENTS

| | | | |
|---|---|---|---|
| 3,534,932 | 10/1970 | Christoffel et al. | 244/153 R |
| 3,570,792 | 3/1971 | Christoffel et al. | 244/153 R |
| 4,736,914 | 4/1988 | Tabor | 244/153 R |
| 4,815,681 | 3/1989 | Crowell | 244/153 R |

FOREIGN PATENT DOCUMENTS

| | | | |
|---|---|---|---|
| 0997791 | 7/1965 | United Kingdom | 244/153 R |

*Primary Examiner*—Mark Hellner

*Attorney, Agent, or Firm*—Beveridge, DeGrandi & Weilacher

[57] ABSTRACT

Sheet material is used for forming connectors for a kite. The leading end of a keel strut is connected to the sail by a nosepiece which is formed of first and second panels having their forward edges connected together and provided with spaced holes that are mutually aligned so that a string looped through the holes and around the keel strut will retain the keel strut in position between these panels. The tailpiece connector is formed of two panels of sheet material having two longitudinal seams connecting them to the sail and to each other to prevent lateral movement of the aft end of the keel strut. The tailpiece connector panels are connected together aft of the keel strut to obstruct rearward movement of the keel strut, and one of these panels has a seam which forms a transverse sleeve for receiving the cross strut and a bridle string. The wing connector connects an end of the cross strut to a wing strut, and it includes first and second panels of flexible sheet material which lie against opposite surfaces of the sail. A seam connects these two panels to each other and to the sail. The wing connector includes an elongated pocket for receiving an end of the cross strut. The elongated pocket is formed of flexible sheet material, and its axis lies at an angle to the wing strut.

24 Claims, 3 Drawing Sheets

FIG. 1
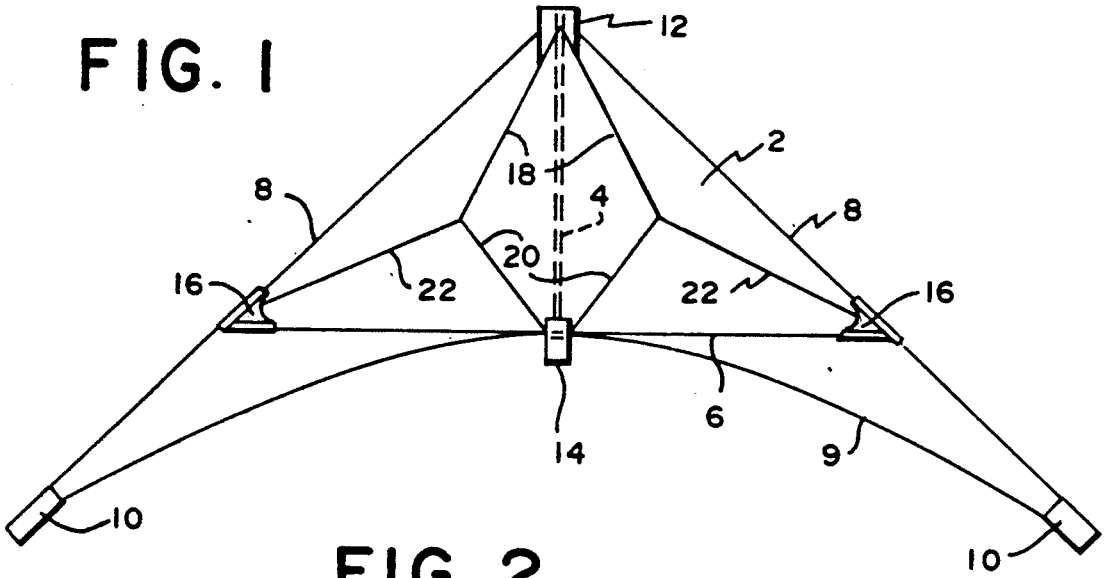
FIG. 2
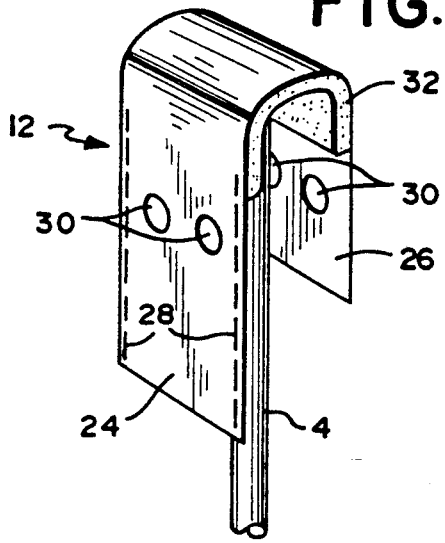
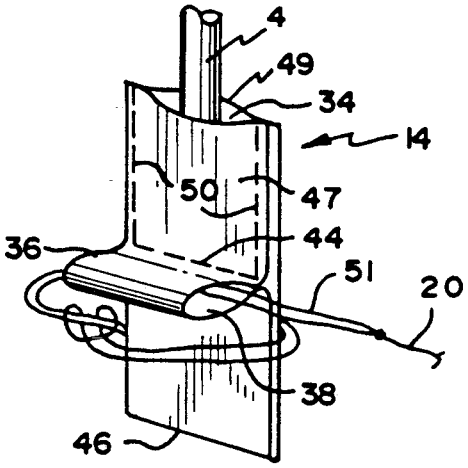
FIG. 4
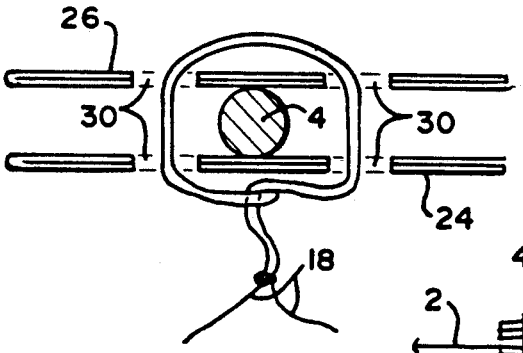
FIG. 3
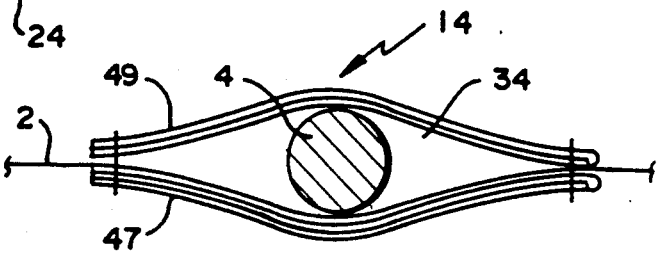
FIG. 5

FIG. 6
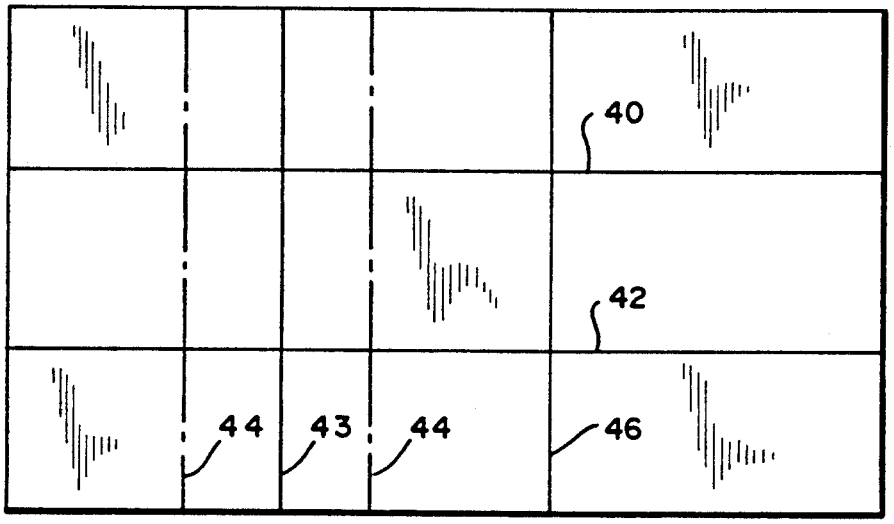
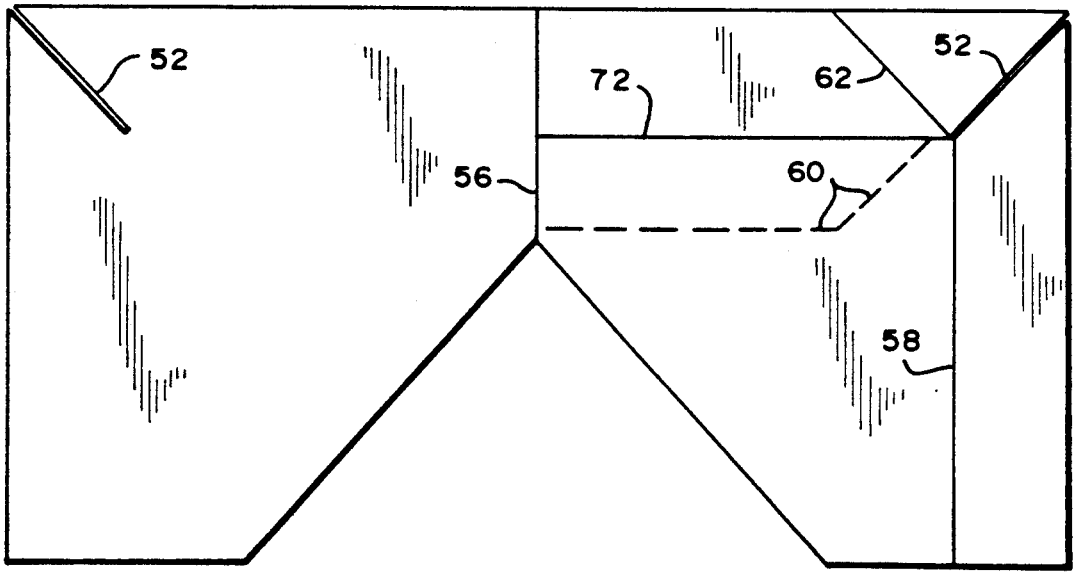
FIG. 7

KITE WITH CONNECTORS FORMED OF SHEET MATERIAL

REFERENCE TO RELATED APPLICATION

This is a continuation-in-part of U.S. patent application 07/319,681, filed Mar. 7, 1989, the content of which is incorporated herein by reference.

BACKGROUND OF THE INVENTION

In recent years, there have been a number of significant improvements in kite construction, as designers have learned to utilize modern material for struts, sail fabrics, connectors, and other components. In some cases, components are manufactured by molding or machining equipment. Such manufacturing processes make the kites more expensive to manufacture and therefore more expensive in the marketplace.

An object of the present invention is to provide a kite which is durable, airworthy, and can be manufactured inexpensively because the connectors used in the kite can be formed of ordinary sheet material which is cut, folded and/or sewn in order to provide a simple, lightweight and highly effective component of the kite.

SUMMARY OF THE INVENTION

A common kite design to which the invention is applicable include a sail, a pair of rearwardly diverging wing struts which lie along the leading edges of the sail, a keel strut which extends longitudinally and centrally of the sail, and a cross strut which has its opposite ends connected to the wing struts.

In one respect, the invention relates to a wing connector which connects an end of a cross strut to a wing strut. The wing connector is formed of interconnected panels of flexible sheet material. First and second panels lie against opposite surfaces of the kite's sail, and a seam connects these two panels to each other and to the sail. The wing connector has an elongated pocket having an axis which lies at an angle to the wing strut. The opposite ends of the cross strut are inserted in the elongated pockets of the wing connectors on the opposed wing struts of the kite.

Preferably, the elongated pocket of the wing connector is formed by and between third and fourth panels which are connected to one of the first and second panels by a fold line. One of the latter panels is deformable to permit the axis of the elongated pocket to assume an acute angle relative to the wing strut. All panels are formed of at least two thicknesses of sheet material. Also, it is preferred to construct the device so that the second panel has first and second edges that lie parallel to the wing strut; a fold line connects the first panel to the first edge of the second panel; and, the third panel extends from the second edge of the second panel. A fold line also connects the fourth panel to the third panel, and a seam connects the third panel to the fourth panel to form the elongated pocket. Aligned holes may be formed in the first and second panels for receiving a bridle string which extends through these holes and around the wing strut.

The invention also concerns a novel nose connector for connecting the leading end of the keel strut to the sail. This nose connector is attached to the sail and is formed of two panels of flexible sheet material which have their forward edges connected together. Each of these panels has a pair of spaced holes that are aligned with corresponding holes on the other such panel. The forward end of the keel strut lies between the panels, and a string is looped through the holes and around the keel strut to retain the keel strut in position between the panels.

Preferably, the nose connector panels lie on opposite sides of the sail, and only one of these panels is directly connected to the sail. The nose connector may include a cushioning material positioned in front of the keel strut, and wing struts may have their forward ends lying between the panels so that the nose connector is positioned to obstruct forward movement of the wing struts. All panels are formed of one or more thicknesses of sheet material.

Another feature of the invention is a tailpiece connector formed of two panels of flexible sheet material which connect the sail to the rear end portion of the keel strut to the sail. These panels are connected to the sail and to each other. The rear end portion of the keel strut and the sail lie between these panels. These panels are connected together aft of the keel strut to obstruct rearward movement of the keel strut. One of the panels has a seam which forms a transverse sleeve through which the cross strut extends. The rear end of the keel strut extends aft of the transverse sleeve and cross strut.

The invention also involves a tailpiece connector formed of two panels of flexible sheet material which serve to connect the rear end portion of the keel strut to the sail. The rear end portion of the keel strut and the sail lie between these panels, and two longitudinal seams connect the panels to the sail and to each other. The longitudinal seams lie on opposite sides of the rear end portion of the keel strut and they prevent lateral movement of the rear end portion of the keel strut. These panels are connected together aft of the keel strut to obstruct rearward movement of the keel strut, and one of the panels has a seam which forms a transverse sleeve. A bridle string extends through the transverse sleeve and is connected to the tailpiece connector.

Preferably, the cross strut extends through the transverse sleeve, and the bridle string includes an end loop that extends through the transverse sleeve and encircles the tailpiece connector. The bottom of the pocket is a transverse fold line which is aft of the cross strut. All panels are formed of one or more thicknesses of sheet material.

The invention may take many forms, only one example of which is provided in this specification and illustrated in the accompanying drawings.

BRIEF DESCRIPTION OF THE DRAWINGS

FIG. 1 is a view of a kite which uses the various features of the invention, as it is seen when flying directly overhead;

FIG. 2 is a perspective view of a nosepiece connector constructed according to the invention;

FIG. 3 is a folding and threading diagram as seen transversely through the nosepiece connector;

FIG. 4 is a perspective view of the tailpiece connector prior to the insertion of the cross strut;

FIG. 5 is a transverse folding and threading diagram of the tailpiece connector:

FIG. 6 is a folding and sewing diagram for the tailpiece connector;

FIG. 7 is a cutting/folding/sewing diagram for the wing connector;

DESCRIPTION OF A PREFERRED EMBODIMENT

Figure 8:
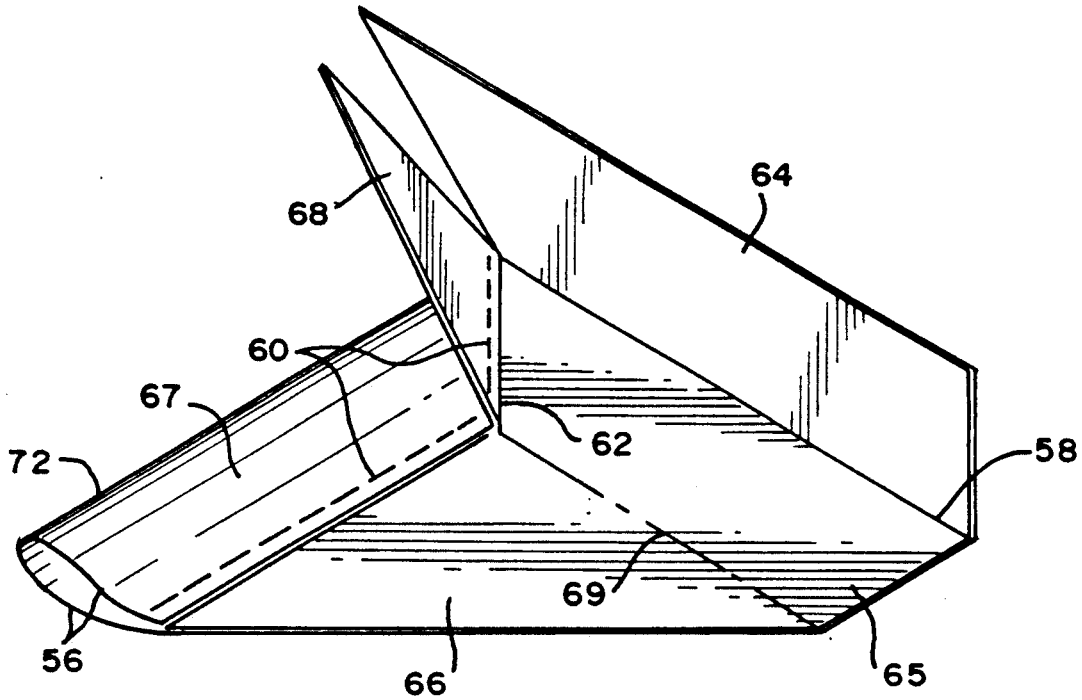
FIG. 8 shows a partially assembled wing connector.

Referring to FIG. 1, it will be seen that the kite has a fabric sail 2, a longitudinal keel strut 4, a transverse cross strut 6, and a pair of wing struts located in hems in the leading edges 8 of the sail. The rear ends of these hems are closed and obstructed by sturdy wingtip pockets 10, but the forward ends of the hems are open to permit insertion of the wing struts. The trailing edge of the sail is designated 9 in the drawings. The keel strut 4 has fore and aft end portions that are connected respectively to the sail by a nosepiece connector assembly 12 and a tailpiece connector assembly 14. The cross strut 6 extends transversely through the tailpiece connector 14, and its opposite end portions are connected to the wing struts by wing connectors 16. For stunt flying controls, the kite has two bridle assemblies, each of which has three strings 18, 20, and 22 that are connected respectively to the nosepiece connector 12, the tailpiece connector 14, and one of the wing connectors 16.

Details of the nosepiece connector are shown in FIGS. 2 and 3. It is formed of a sheet of durable fabric that is initially folded longitudinally to provide triple thicknesses and then folded transversely so that it comprises two panels 24 and 26 that have their forward edges connected together. The lower panel 24 is connected to the sail by longitudinal seams 28, but the upper panel 26 is not directly connected to the sail. Each of the panels 24 and 26 has two spaced holes 30 that are aligned with corresponding holes in the other panel. To reduce the risk of collision damage, a sheet 32 of foam cushioning material is sewn or bonded on the interior surface of the nosepiece panels, aligned with the axes of the keel strut and both wing struts.

The keel strut 4 is above the sail when the kite is flying overhead. As shown in FIG. 3, the forward end of the keel strut lies between the two nosepiece connector panels 24 and 26, and a bridle string 18 is looped through the holes 30 and around the keel strut to retain the keel strut in position laterally and between the panels.

The tailpiece connector 14, shown in FIGS. 4 and 5, has a longitudinally elongated pocket 34 for receiving the aft end of the keel strut 4. A transverse sleeve 36 receives the bridle strings 20 and, if desired, the cross strut 6. The tailpiece connector 14 is formed of a rectangular piece of fabric. As shown in FIG. 6, it is folded at 40, folded at 42, folded at 43, stitched together at 44 to form the sleeve 36, and folded at 46 to form the bottom of the pocket 34. As shown in FIG. 4, this fold 46 is the connection between two panels 47 and 49 which are then sewn to the sail at 50. The seams formed by the latter step connect the panels 47 and 49 to the sail and to each other. These seams form two sides of the elongated longitudinal pocket for the aft end portion of the keel strut to prevent its lateral movement.

The keel strut 4 extends to the fold 46 which forms the bottom of the pocket. In the configuration shown in FIG. 1, the cross strut 6 is inserted transversely through the sleeve 36, and the bridle strings are connected to the sleeve 36. As shown in FIG. 4, the bridle string 20 has an end loop 51 that extends entirely through the sleeve 38 and then laterally encircles the tailpiece connector forwardly of the sleeve 36. The opposite bridle string, omitted from FIG. 4, is a mirror image of the bridle string 20. The bridle loop 51, when inserted in the sleeve 36 and secured around the tailpiece connector aft of sleeve 36 with a slip knot, will not slip off of the tailpiece connector 14.

The wing connector 16 is also formed from a blank of fabric. The blank, shown in FIG. 7, has diagonal corner slits 52 and a triangular cutout 54. It is folded left at 56 so that the left half overlies the right half, whereby all panels of the device will have at least two thicknesses of material. Then it is folded down at 72, stitched at 60 to form the elongated pocket for the cross strut, folded up and diagonally left at 62, and then folded at 72. At this stage, the wing connector appears as shown in FIG. 8. It can be described in terms of five panels 64, 65, 66, 67 and 68. The first panel 64 is connected to the second panel 65 by the fold line 58. The boundary between the panels 65 and 66 is shown a dot-dash line 69. Fold line 72 connects the panels 66 and 67 together; and, the fold line 62 connects the triangular fifth panel 68 to the fourth panel 67.

Figure 9:
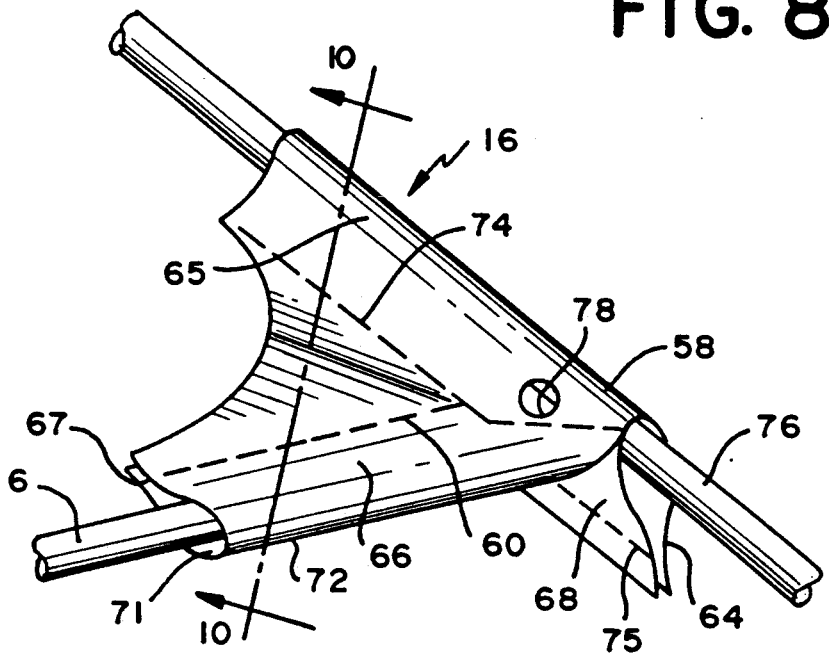
FIG. 9 is a perspective view of the wing connector.
Figure 10:
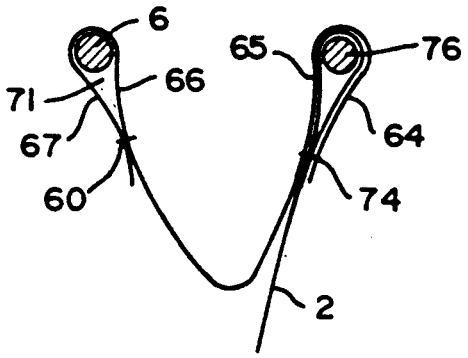
FIG. 10 is a sectional view taken along the line 10—10 in FIG. 9.

The wing connector is inverted and then positioned so that the fold 58 is aligned with the leading edge of the sail, and the first panel 64 is positioned on an opposite surface of the sail from the panels 65 and 68 as shown in FIG. 10. The panels 65 and 68 are substantially coplanar with each other. Stitching is applied at 74 to attach the panels 64 and 65 to the sail and to each other, and additional stitching is applied at 75 to connect the panels 64 and 68 to each other and to the sail. As shown in FIG. 9, the completed wing connector thus has the first panel 64 extending along the margin of the upper surface of the sail when the kite is flying overhead. The second panel 65 extends along the margin of the lower surface of the sail; the third panel 66 extends in an inboard direction from the second panel; and, the fourth panel 67 overlies a portion of the third panel and is attached thereto to form the elongated pocket 71 that receives the end of the cross strut 6. The small triangular panel 68 has a forward portion which overlies portions of the panels 67,66 and 65, and an aft portion which extends aft of and substantially coplanar with the panel 65.

Due to the acute angular relationship between the cross strut 6 and the wing strut 76, the panel 66 is normally bowed toward the sail when the kite is assembled. This configuration is shown in FIG. 10.

Aligned holes 78 for receiving an end loop of a bridle string 20 are formed in the panels 64 and 65. Additionally, a cross string can be connected to and extend between these holes 78 on both sides of the kite to limit the outboard movement of the wing connectors 16, thus keeping the cross strut 6 securely seated in both pockets.

When the cross strut passes through the sleeve 36 as shown in FIG. 1, the sail is stabilized and light wind performance is improved. When higher performance and in-flight draft adjustment are desired, the kite may be rigged as shown in FIG. 4 so the cross strut 6 does not pass through the sleeve.

The opposite wing connector is a mirror image of the above-described wing connector.

From the foregoing, it will be appreciated by those skilled in the art that the invention presents an uncomplicated and effective solution to the problems associated with the interconnection of kite components. The resulting kite is durable, it flies well, and it is relatively simple and inexpensive to manufacture, thus making the recreational activity of high performance kite flying available to more people.

Persons familiar with the art will recognize that the invention may take many forms other than the specific embodiment shown herein. With this in mind, it is emphasized that the invention is not limited solely to the disclosed embodiment, but is embracing of a wide variety of structures which fall within the spirit of the following claims.

I claim:

1. A kite having a sail, a pair of wing struts, a cross strut having two end portions, and wing connector means for connecting the end portions of the cross strut to the wing struts, each of said wing connector means being a plurality of interconnected panels of flexible sheet material, first and second said panels of said wing connector means lying against opposite surfaces of the sail, a seam connecting said two panels to each other and to the sail, said wing connector means including an elongated pocket formed of flexible sheet material and having an axis which lies at an angle to said wing strut, said cross strut having its end portions inserted in said elongated pockets.

2. A kite according to claim 1, said elongated pocket being formed by and between third and fourth panels which are connected to one of said first and second panels.

3. A kite according to claim 2, one of said third and fourth panels being deformable to permit the axis of said elongated pocket to assume an acute angle relative to said wing strut.

4. A kite according to claim 1 wherein all of said panels are formed of at least two thicknesses of sheet material.

5. A kite according to claim 2 wherein said second panel has first and second edges that lie parallel to the wing strut, a fold line connecting the first panel to the first edge of the second panel, said third panel extending from the second edge of the second panel.

6. A kite according to claim 5 wherein a fold line connects the fourth panel to the third panel.

7. A kite according to claim 2 wherein a seam connects the third panel to the fourth panel to form said elongated pocket.

8. A kite according to claim 1 wherein aligned holes are formed in the first and second panels, and a bridle string extends through said holes and around the wing strut.

9. A kite having a sail, a keel strut, a pair of wing struts, and a nose connector means for connecting the keel strut to the sail, said nose connector mean being attached to the sail and including two panels of sheet material having forward edges that are connected together, each of said panels having a pair of spaced holes that are aligned with corresponding holes on the other said panel, said keel strut having a forward end portion lying between said panels, and a string looped through said holes and around said keel strut to retain the keel strut in position between said panels.

10. A kite according to claim 9 including a pair of wing struts having forward end portions that lie between said panels, said nose connector means positioned to obstruct forward movement of the wing struts.

11. A kite according to claim 9 wherein said nose connector means includes a cushioning material positioned in front of the forward end portion of the keel strut.

12. A kite according to claim 9 wherein said panels lie on opposite sides of said sail.

13. A kite according to claim 9 wherein only one of said panels is directly connected to said sail.

14. A kite according to claim 9 having a bridle string assembly, said string being a portion of said bridle string assembly.

15. A kite having a sail, a cross strut, a keel strut having a rear end portion, and a tailpiece connector means for connecting the sail to the cross strut and to the rear end portion of the keel strut, said tailpiece connector means including two panels of sheet material, said rear end portion of the keel strut lying between said panels, seams connecting the panels to said sail and to each other, said seams lying on opposite sides of the rear end portion of the keel strut, said panels being connected together aft of the keel strut to obstruct rearward movement of the keel strut, one of said panels of sheet material having a seam which forms a transverse sleeve, said cross strut extending through said transverse sleeve, said keel strut having its rear end extending aft of said transverse sleeve and cross strut.

16. A kite according to claim 15 having a bridle string extending through said transverse sleeve and connected to said tailpiece connector.

17. A kite according to claim 16 wherein said bridle string includes an end loop that transversely encircles the tailpiece connector after passing through said transverse sleeve.

18. A kite according to claim 15 wherein said tailpiece connector has a transverse fold line which connects the panels together aft of the keel strut.

19. A kite having a sail, a keel strut having a rear end portion, and a tailpiece connector means for connecting the sail to the rear end portion of the keel strut, said tailpiece connector means including two panels of sheet material, said rear end portion of the keel strut lying between said panels, seams connecting the panels to said sail and to each other, said seams lying on opposite sides of the rear end portion of the keel strut, said panels being connected together aft of the keel strut to obstruct rearward movement of the keel strut, one of said panels of sheet material having a seam which forms a transverse sleeve, and a bridle string extending through said transverse sleeve and connected to said tailpiece connector.

20. A kite according to claim 19 having a cross strut extending through said transverse sleeve.

21. A kite according to claim 19 wherein said bridle string includes an end loop that transversely encircles the tailpiece connector after passing through said transverse sleeve.

22. A kite according to claim 19 wherein said tailpiece connector has a transverse fold line which connects the panels together aft of the keel strut, said transverse fold line lying aft of the transverse sleeve and being aligned with the keel strut to prevent rearward movement of the keel strut.

23. A kite having a sail, a pair of wing struts, a cross strut having two end portions, and a keel strut having a forward end portion and a rear end portion, wing connector means for connecting the end portions of the cross strut to the wing struts, each of said wing connector means being a plurality of interconnected wing connector panels of flexible sheet material, first and second said wing connector panels of said wing connector means lying against opposite surfaces of the sail, a seam connecting said first and second wing connector panels to each other and to the sail, said wing connector means including an elongated pocket formed of flexible sheet material and having an axis which lies at an angle to said wing strut, said cross strut having its end portions inserted in said elongated pocket, nose connector means for connecting the keel strut to the sail, said nose connector mean being attached to the sail and including two nose connector panels of sheet material having forward edges that are connected together, each of said nose connector panels having a pair of spaced holes that are aligned with corresponding holes on the other said nose connector panel, said forward end portion of the keel strut lying between said nose connector panels, and a string looped through said holes and around said keel strut to retain the keel strut in position between said nose connector panels, tailpiece connector means for connecting the sail to the rear end portion of the keel strut, said tailpiece connector means including two tailpiece connector panels of sheet material, said rear end portion of the keel strut lying between said tailpiece connector panels, seams connecting the tailpiece connector panels to said sail and to each other, said seams lying on opposite sides of the rear end portion of the keel strut, said tailpiece connector panels being connected together aft of the keel strut to obstruct rearward movement of the keel strut, one of said tailpiece connector panels having a seam which forms a transverse sleeve, said cross strut and a bridle string extending through said transverse sleeve and connected to said tailpiece connector, said keel strut having its rear end extending aft of said transverse sleeve and cross strut.

24. A kite according to claim 2 having a fifth panel which is connected to the fourth panel by a fold line, said fifth panel being coplanar with and extending aft of the second panel.

* * * * *